US006561670B1

(12) United States Patent
Jongewaard et al.

(10) Patent No.: US 6,561,670 B1
(45) Date of Patent: May 13, 2003

(54) SEMI-RECESSED DOWNLIGHT WALL WASH CANOPY LUMINAIRE

(75) Inventors: Mark Paul Jongewaard, Arvada, CO (US); Katsuhiro Unoki, Vallejo, CA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/037,528

(22) Filed: Jan. 4, 2002

(51) Int. Cl.[7] ..... F21V 21/04

(52) U.S. Cl. ..... 362/147; 362/364; 362/297; 362/346

(58) Field of Search ..... 362/147, 148, 362/150, 364, 405, 297, 346, 332

(56) References Cited

U.S. PATENT DOCUMENTS

| | | | | |
|---|---|---|---|---|
| 1,676,464 | A | 7/1928 | Ryan | |
| 1,900,436 | A | 3/1933 | Dourgnon | |
| 2,238,493 | A | 4/1941 | Lintern et al. | |
| 2,352,801 | A | 7/1944 | Rolph | |
| 3,131,874 | A | 5/1964 | Fairbanks | |
| 3,340,393 | A | 9/1967 | Franck et al. | |
| 4,213,171 | A | 7/1980 | Sassmannshausen | 362/310 |
| 4,559,589 | A | 12/1985 | Sassmannshausen | 362/305 |
| 4,856,103 | A | 8/1989 | Compton | 362/340 |
| 5,086,375 | A | 2/1992 | Fabbri | 362/33 |
| 5,251,116 | A | 10/1993 | Wijbenga et al. | 362/308 |
| 5,375,045 | A | 12/1994 | Ruud et al. | 362/147 |
| 5,416,683 | A | 5/1995 | McCarthy | 362/328 |
| 5,416,684 | A | 5/1995 | Pearce | 362/340 |
| 5,486,989 | A | 1/1996 | Compton | 362/291 |
| D412,040 | S | 7/1999 | Hudak et al. | D26/87 |
| 6,027,231 | A | 2/2000 | Fouke | 362/309 |
| 6,042,251 | A | 3/2000 | McCarthy et al. | 362/308 |
| D425,221 | S | 5/2000 | Burns | D26/26 |
| 6,062,704 | A | 5/2000 | Holder | 362/223 |
| 6,116,749 | A | 9/2000 | Quiogue et al. | 362/148 |
| D437,077 | S | 1/2001 | Minissi | D26/85 |
| 6,350,047 | B1 * | 2/2002 | Ng et al. | 362/364 |
| 2001/0033487 | A1 | 10/2001 | Crellin | 362/147 |

* cited by examiner

*Primary Examiner*—Laura K. Tso
(74) *Attorney, Agent, or Firm*—Jeffrey A. Haeberlin; Middleton Reutlinger

(57) ABSTRACT

A semi-recessed downlight wall wash canopy luminaire includes a plaster frame, a lamp socket, a lamp, a downlight reflector, a wall wash reflector, and a trim piece. The plaster frame mounts behind the canopy or ceiling sheeting for supporting the components of the luminaire in relation to an opening in the sheeting. The lamp socket holds the lamp above the opening. The downlight and wall wash reflectors are positioned in surrounding relation to the lamp. The wall wash reflector has a bottom portion which extends below the plaster frame and the sheeting for reflecting light toward a wall at high angles. A trim piece extends downward from the plaster frame and below the bottom portion of the wall wash reflector providing a finished appearance. The trim piece has a bottom opening and a side window, which may be covered by refractive lenses.

23 Claims, 6 Drawing Sheets

SEMI-RECESSED DOWNLIGHT WALL WASH CANOPY LUMINAIRE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to light fixtures, or luminaires, and more particularly to a semi-recessed luminaire having both downlight and wall wash optical functions.

2. Description of Prior Art

Recessed light fixtures are popular design choices, providing direct illumination to a workspace while concealing the lamp, internal components (sockets, wiring, junction boxes, ballast, temperature switches, etc.) and mounting hardware of the fixture behind the plane of the mounting surface, usually a ceiling or canopy. With the addition of specialized optics, recessed light fixtures can achieve effects such as wall washing.

Recessed wall wash light fixtures are designed to project light from a recessed ceiling fixture located close to a wall at a range of angles to illuminate the wall from the top to the bottom. This, in effect, "washes" the wall with light. Since the lamp in such a fixture is recessed in the ceiling, the wall wash effect requires light from the lamp to be directed downwardly and outwardly in the direction of the wall. However, since light generally travels in a straight path through a medium such as air, it is very difficult to direct light from a completely recessed fixture high on the wall toward the junction of the ceiling and the wall.

Additionally, the optical performance of traditional recessed light fixtures is constrained by the requirement that the optical system of the fixture be located completely above the plane of the ceiling or canopy. Thus, the optical performance is limited to variations on the cone of light projected through the opening in the ceiling or canopy.

BRIEF SUMMARY OF THE INVENTION

Thus, it is an object of the present invention to provide a semi-recessed downlight wall wash light fixture for installation in a ceiling or canopy for illumination of both the pathway or area underneath the canopy luminaire and a wall adjacent thereto.

It is a further objective of the invention to provide a semi-recessed luminaire having refractor optics for producing an elongated beam for illumination of an elongated area underneath the fixture.

It is another object of the present invention to provide a semi-recessed canopy luminaire capable of washing the adjacent wall completely from the top of the wall to the ground.

These and other objects are achieved through an improved luminaire mounted mostly behind a ceiling or canopy through the use of a plaster frame having an opening as described herein. A lamp socket is provided for holding a lamp in a recessed arrangement to the canopy and frame since the light generation region of the lamp is generally aligned with the opening of the frame and the canopy. A downlight reflector is positioned partially around the light generation region of the lamp for directing light downward out of the luminaire. Also provided is a wall wash reflector positioned partially around the light generation region of the lamp adjacent to and complimentary with the downlight reflector. A bottom portion of the wall wash reflector extends through the opening in the frame and below the plane of the canopy. Thus, the bottom portion of the wall wash reflector is able to direct light all the way to the top of the wall. A trim piece-is also provided for concealing the bottom portion of the wall wash reflector which extends downward from the frame. The trim piece has a bottom opening which allows the downward directed light to leave the luminaire, and a side window located opposite to the bottom portion of the wall wash reflector for allowing the light directed toward the wall to also exit the luminaire.

To improve the optical performance of the light directed downward out of the fixture, the trim piece may further include a downlight lens covering the bottom opening.

Additionally, to further improve the optical performance of the wall wash light, the trim piece may also include a wall wash lens covering the side window.

DETAILED DESCRIPTION OF THE INVENTION

Figure 1:
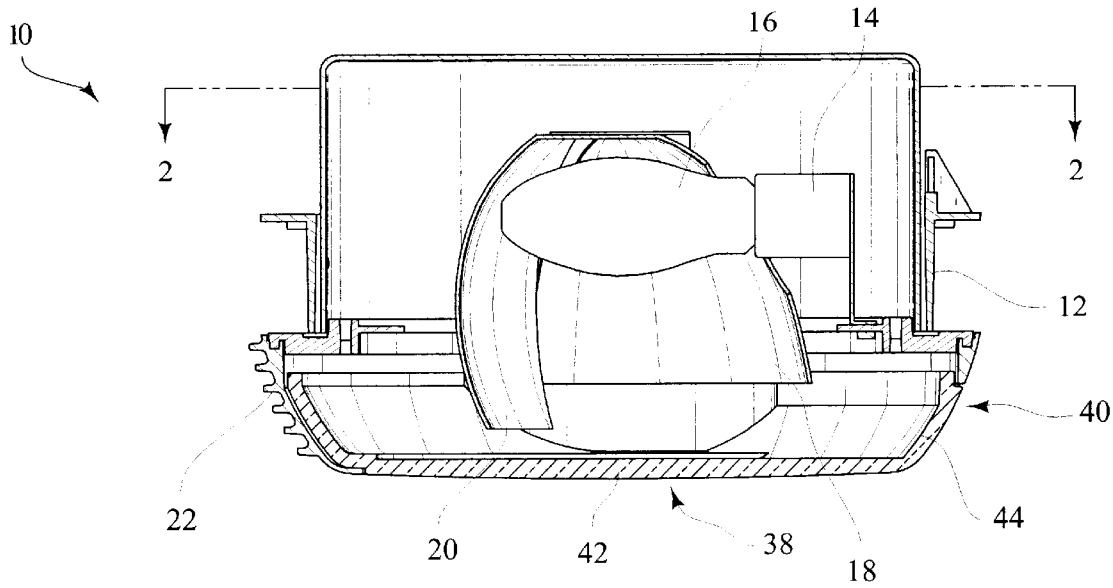
FIG. 1 is a side section view taken along line 1—1 of FIG. 2 of a semi-recessed canopy luminaire of the present invention.

A semi-recessed canopy luminaire 10 of the present invention is shown in FIG. 1. The luminaire 10 has a plaster frame 12, a lamp socket 14, a lamp 16, a down light reflector 18, a wall wash reflector 20, and a trim piece 22.

Figure 3:
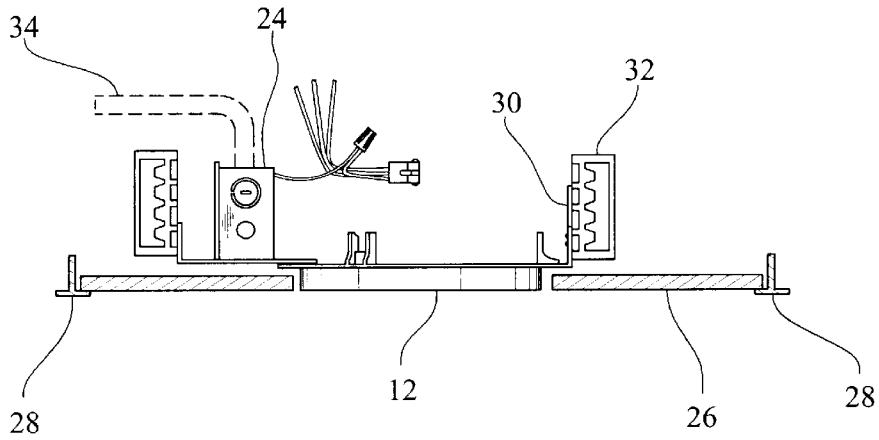
FIG. 3 is a side sectional view of a plaster frame of the present invention.
Figure 4:
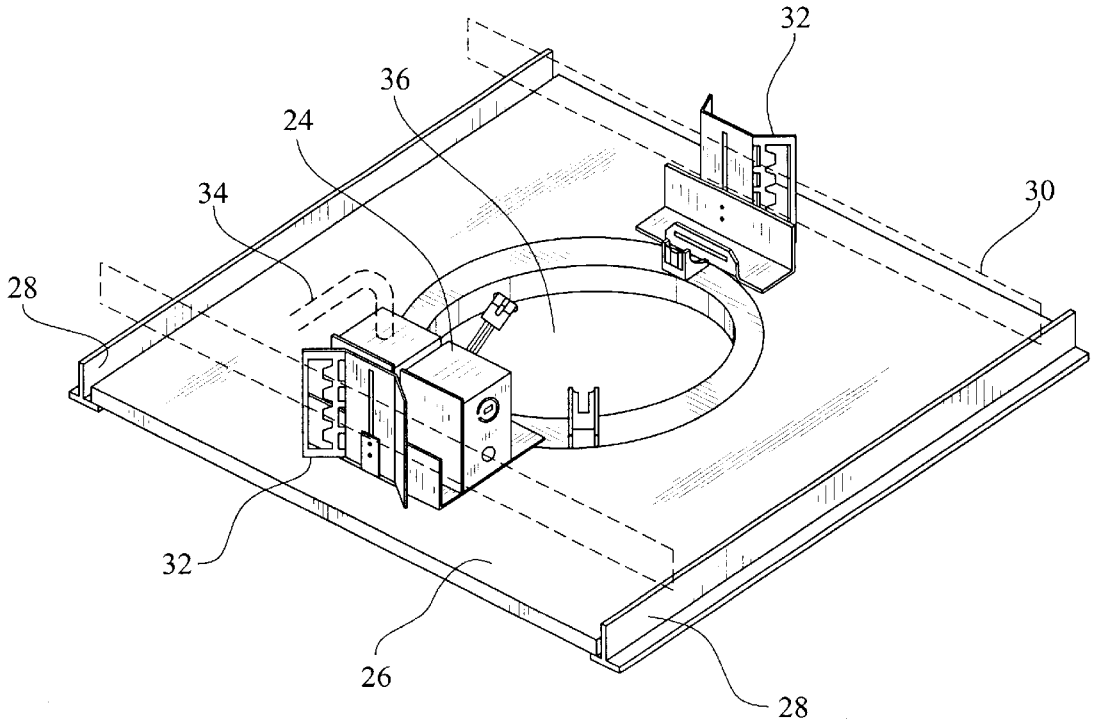
FIG. 4 is a perspective view of the plaster frame of FIG. 3.

As best shown in FIGS. 3 and 4 the plaster frame 12 provides a mechanical support to which the luminaire components mentioned above and the junction box 24 can be mounted. Since the canopy or ceiling sheeting 26 is generally not designed to support additional weight, the plaster frame 12 may be supported between building structural members 28, such as joists or the like, by frame support members 30 which span the building structural members 28 and support the plaster frame 12 through its mounting support members 32. Power feed 34 provides electric power to the junction box 24. Plaster frame 12 defines an opening 36 which coincides with an opening in the canopy sheeting 26 through which light will pass from the luminaire.

Returning now to FIG. 1, the lamp socket 14 holds a lamp 16 in alignment with the plaster frame opening 36. The lamp 16 will have a light generating region, for instance, a filament or an arc, around which the optical system of the luminaire is designed. Since different types of lamps will have different light generating regions, the exact type of lamp is not a limitation of the invention, but rather, defines the light generation region around which the optical system is designed. Thus, the invention may utilize, for example, such lamps as a 150 watt metal halide lamp, a 150 watt high pressure sodium lamp, or a 42 watt compact fluorescent lamp. These selections, however, are exemplary only.

Returning now to FIG. 1, the lamp 16 is shown having a horizontal orientation along its longitudinal axis. This orientation allows the luminaire to have a shallower depth than, say, for instance, if the lamp were to have a vertical orientation. However, one of skill in the art will recognize that the lamp may have any possible orientation without departing from the scope of the invention.

Figure 2:
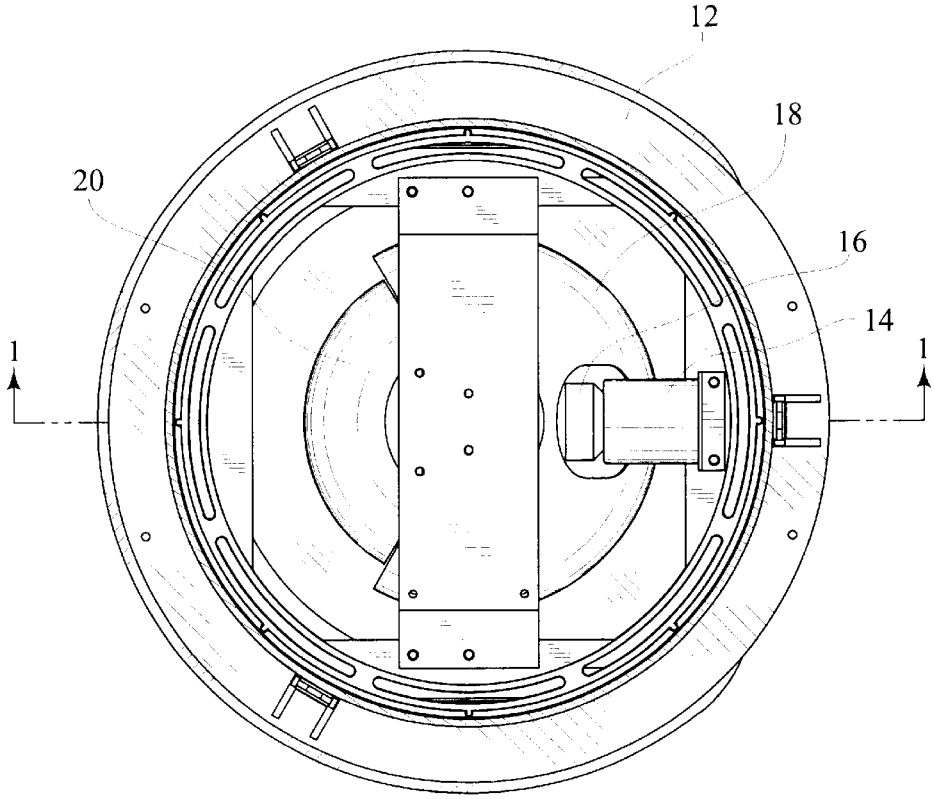
FIG. 2 is a sectional view taken along line 2—2 of FIG. 1.

As shown in FIGS. 1 and 2, downlight reflector 18 and wall wash reflector 20 are positioned in surrounding relationship to the light generation region of the lamp 16. Thus, light is directed downward and outward from the luminaire 10. As best shown in FIG. 2, the downlight reflector 18 of the shown embodiment extends approximately 240° around the lamp 16. The wall wash reflector 20 thus extends the remaining 120° about the lamp. It should be noted however, once again, that the exact angular measurements of the optical system are not a limiting factor of the present invention and may be varied without departing from the scope of the invention.

As shown in FIG. 1, the bottom portion of the wall wash reflector 20 extends through the opening in the plaster frame 12 and below the lower edge of the down light reflector 18. Thus, the bottom portion of the wall wash reflector 20 extends below the plaster frame 12 and, when installed in a canopy, below the canopy sheeting. This configuration creates a luminaire that is only semi-recessed.

Figure 5:
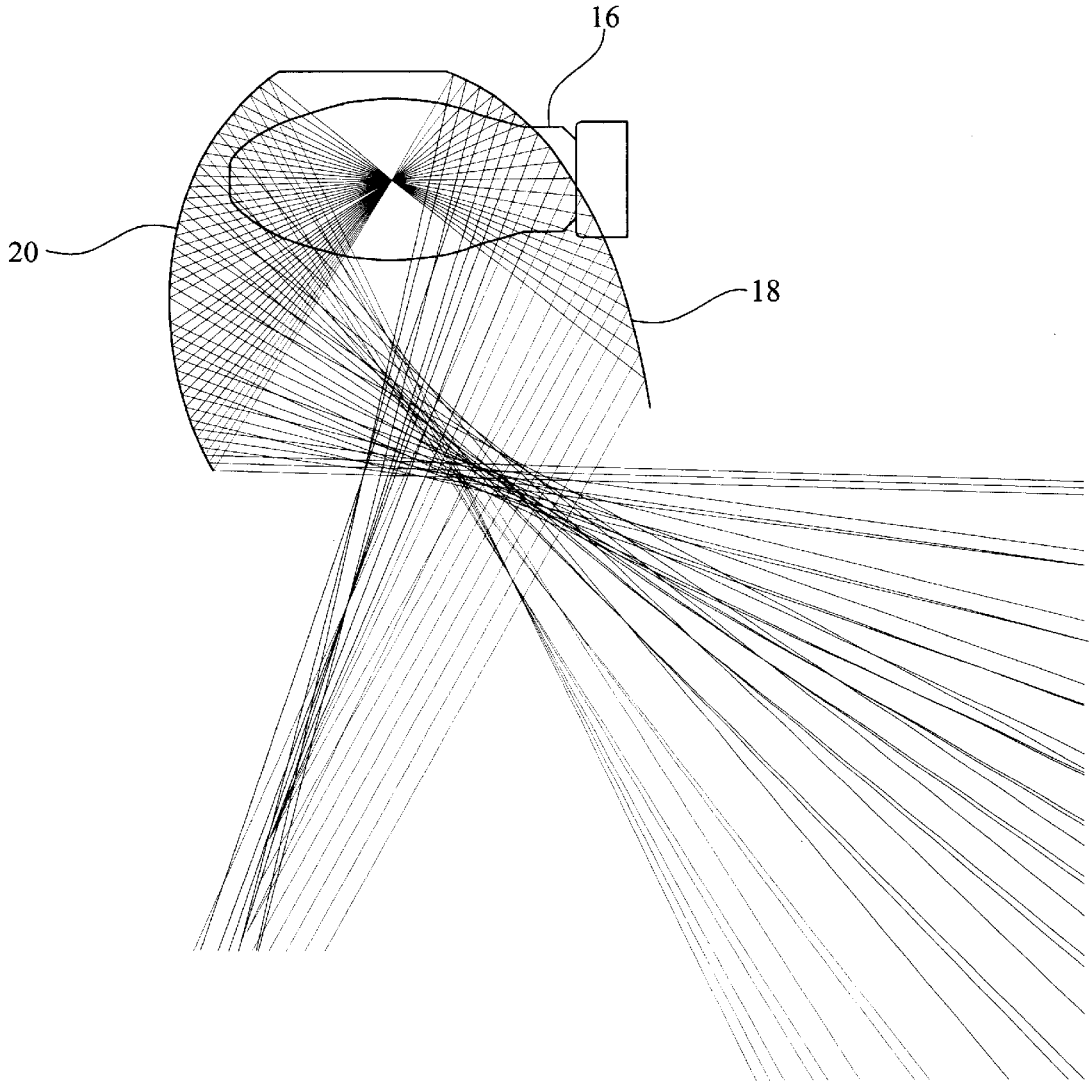
FIG. 5 is a ray traced diagram of the reflector system of the present invention.

Further, as shown in FIG. 5, the reflector configuration allows the wall wash reflector 20 to reflect light from the light generation region of the lamp 16 toward the wall at high angles that reach the top of the wall. In fact, the described configuration allows wall wash light to be directed at angles up to 90°. Additionally, the down light reflector 18 reflects light from the light generation region of the lamp 16 downward out of the luminaire 10 at relatively low angles to prevent glare when viewing the fixture from locations away from the wall. The exact contour of the downlight reflector 18 can be designed as desired for emission angles based on the height and location of the luminaire 10.

Returning again to FIG. 1, it is seen that trim piece 22 extends downward from the plaster frame 12 and below the bottom portion of wall wash reflector 20. Thus, trim piece 22 conceals the bottom portion of wall wash reflector 20 and provides a finished appearance to the luminaire.

Figure 6:
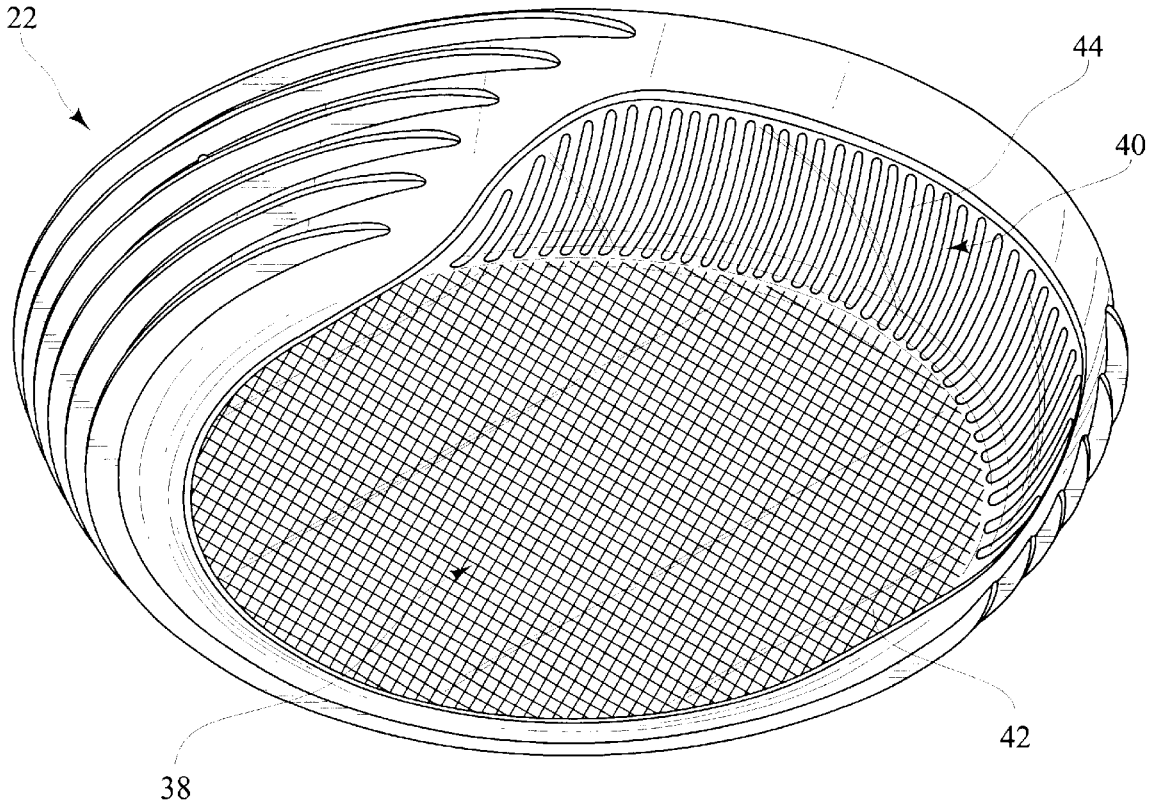
FIG. 6 is a perspective view of a trim piece having refractor optics of the present invention.

As seen in FIGS. 1 and 6, the trim piece 22 extends downward from the plaster frame 12 and below the lower portion of wall wash reflector 20. Thus, the trim piece 22 conceals the lower portion of the wall wash reflector 20 and provides a finished appearance to the luminaire 10. The trim piece 22 further has a bottom opening 38 and a side window 40. The side window 40 is positioned opposite to the bottom portion of the wall wash reflector 20 and adjacent to a wall (not shown) in order to allow light reflected off of the wall wash reflector 20 to exit the luminaire and reach the top of the wall. It is possible that the wall wash reflector 20 could be designed to reflect light on to the under side of the canopy or ceiling surface, thus exiting the luminaire at angles even greater than 90°.

Down light lens 42 may be provided to cover the bottom opening 38 of the trim piece 22. By incorporating refractor optics in the downlight lens 42, the luminaire may further control and direct the light exiting the luminaire through the bottom opening 38 of the trim piece 22.

Figure 7:
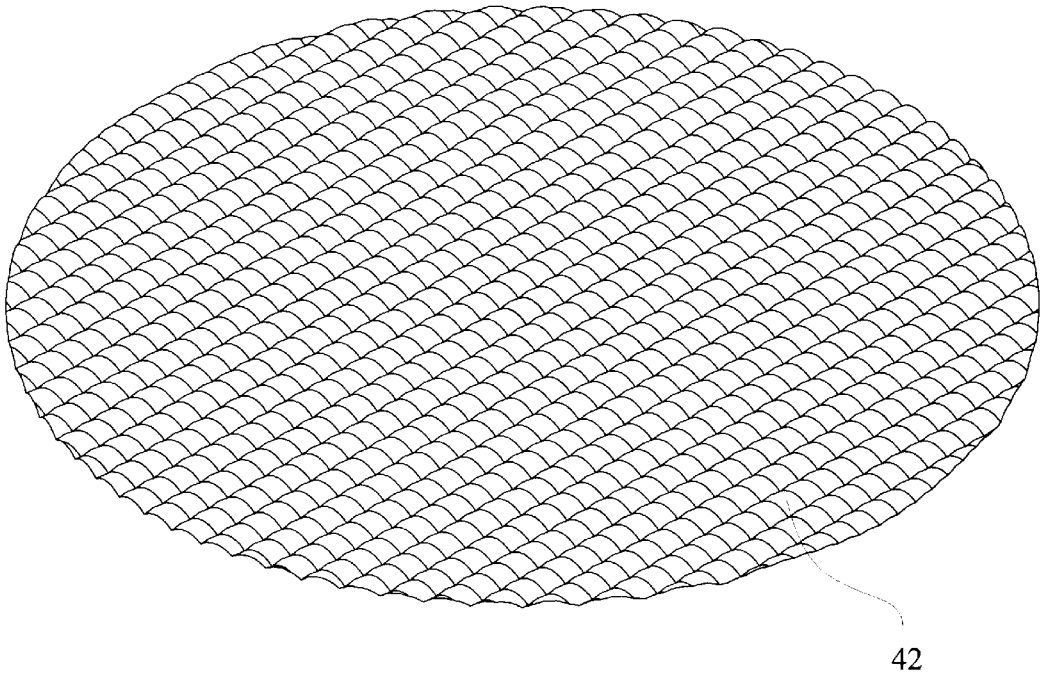
FIG. 7 is a close up view of a toroidal pillow refractor of an embodiment of the present invention.
Figure 8:
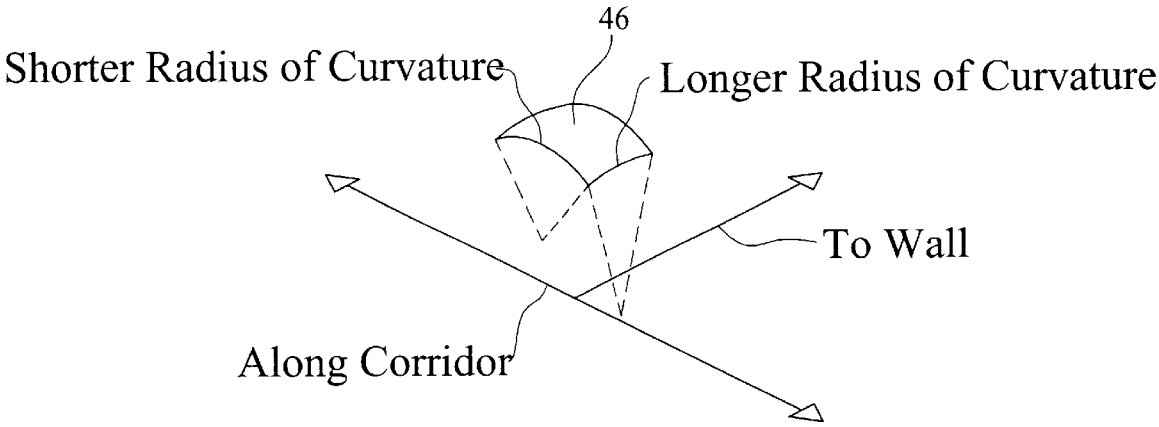
FIG. 8 is demonstrative view of the optical performance of a single pillow of the refractor of FIG. 7.

One possible type of refractor optics for the downlight lens 42 is shown in FIGS. 7 and 8. These figures show a toroidal pillow refractor lens which is comprised of an array of single toroidal optic elements 46. Each single toroidal optic element 46 is a section of a toroid (i.e. a doughnut) which has a different radius of curvature in each direction. Thus, by varying the radii of each element, light passing through the downlight lens 42 may be redirected in an elongated pattern along the corridor beneath the luminaire 10, as illustrated in FIG. 8. One of skill in the art, however, will recognize that additional refractor designs, or a clear lens with no refracting properties may be used to achieve a range of optical performance without departing from the spirit or the scope of the herein described invention.

Figure 9:
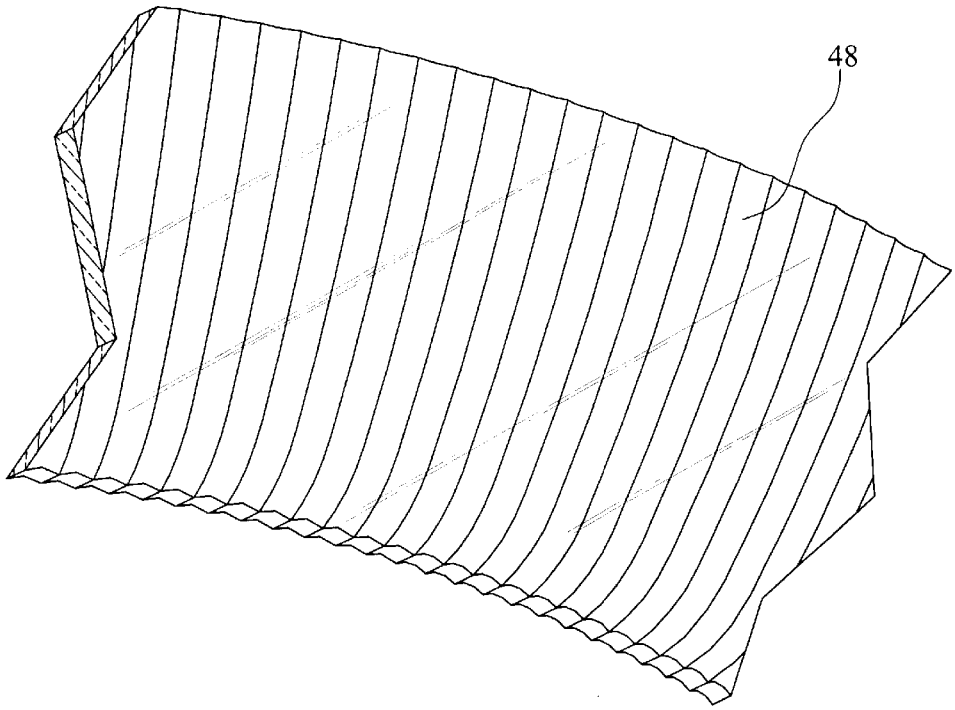
FIG. 9 is a close up view of a fluted wall wash refractor of the present invention.

Returning to FIGS. 1 and 6, the shown embodiment also provides a wall wash lens 44 which covers the side window 40 of the trim piece 22. The wall wash lens 44 may also incorporate refractor optics for further control and direction of light exiting the luminaire 10 through the side window 40 of the trim piece 22. Thus, in the embodiment shown in FIGS. 6 and 9, the wall wash lens 44 incorporates fluted refractor optics 48 for evenly distributing light over an elongated area of the adjacent wall.

Further, in the embodiment shown in FIGS. 1 and 6, the downlight lens 42 and the wall wash lens 44 may be fabricated integral with each other and sealed with the trim piece 22 in order to cover the bottom opening 38 and side window 40 to exclude insects, moisture, dust, and pollutants from the interior of the luminaire.

Figure 10:
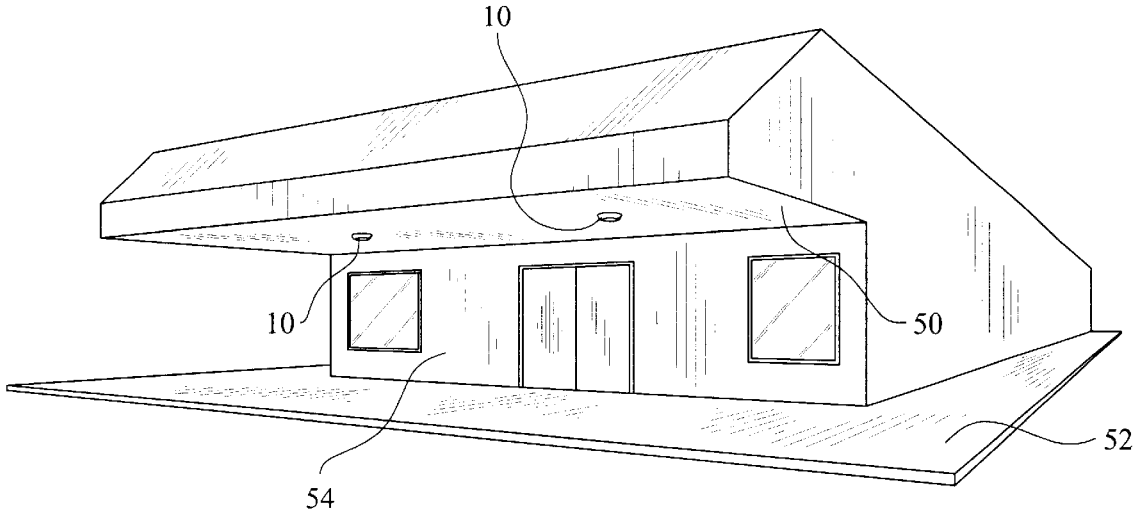
FIG. 10 is an illustration of a luminaire of the present invention as used in a typical installation setting.

Thus, as shown in FIG. 10, a semi-recessed downlight wall wash luminaire 10 of the present invention may be installed in a ceiling or canopy 50 for illumination of both the area or pathway 52 under the luminaire 10 and the wall 54 adjacent thereto.

This detailed description of the preferred embodiment, including specific angles and dimensions, shall not be construed as a limitation of the following claims, as it will be readily apparent to those skilled in the art that design choices may be made changing the configuration of the luminaire without departing from the spirit or scope of the invention.

What is claimed is:

1. A luminaire comprising:

a plaster frame having an opening;

a lamp socket for holding a lamp above said opening, said lamp having a light generation region, said lamp socket thus determining the location of light generation region;

a downlight reflector positioned partially around said light generation region;

a wall wash reflector positioned partially around said light generation region adjacent and complementarily to said downlight reflector, said wall wash reflector having a bottom portion extending through said opening into an area on a second side of said frame;

a trim piece extending downward from said frame, said trim piece having a bottom opening and a side window, said side window opposed to said wall wash reflector bottom portion.

2. The luminaire of claim 1, said downlight reflector having a predetermined contour for reflecting light from said light generation region downward out of said luminaire.

3. The luminaire of claim 1, said wall wash reflector having a predetermined contour for reflecting light from said light generation region downward and outward at high angles out of said luminaire.

4. The luminaire of claim 1, said trim piece further comprising a downlight lens covering said bottom opening.

5. The luminaire of claim 4, said downlight lens being prismatic.

6. The luminaire of claim 5, said prismatic downlight lens having toroidal pillow refractor optics.

7. The luminaire of claim 1, said trim piece further comprising a wall wash lens covering said side window.

8. The luminaire of claim 7, said wall wash lens being prismatic.

9. The luminaire of claim 8, said prismatic wall wash lens having fluted refractor optics.

10. A downlight wall wash luminaire, comprising:

a frame;

a lamp socket affixed to said frame;

a lamp area defined by said lamp socket;

a downlight reflector partially surrounding said lamp area;

a wall wash reflector partially surrounding said lamp area;

said downlight reflector and said wall wash reflector substantially surrounding said lamp area;

further wherein said wall wash reflector extends downward to a point below a lower end of said downlight reflector;

said luminaire further having a trim piece affixed to said frame and extending below said downlight reflector and said wall wash reflector and having at least one lens thereon.

11. The downlight wall wash luminaire of claim 10 wherein said downlight reflector surrounds said lamp area exclusive of said wall wash reflector.

12. The downlight wall wash luminaire of claim 11 wherein said downlight reflector surrounds said lamp area about 240° around said lamp area.

13. The downlight wall wash luminaire of claim 12 wherein said wall wash reflector surrounds said lamp area about 120°.

14. The downlight wall wash luminaire of claim 10 wherein said wall wash reflector extends downward below said frame, wherein said frame is affixed to a ceiling and has an aperture formed therein, wherein said downlight reflector and said wall wash reflector extend downward through said aperture, and wherein said lamp socket is retained above said aperture.

15. The downlight wall wash luminaire of claim 14 wherein said downlight reflector and said wall wash reflector are retained to said frame above said lamp area and retained above said aperture and said frame, said luminaire thereby being partially recessed above said ceiling.

16. The downlight wall wash luminaire of claim 13 wherein said trim piece has a bottom opening and a side window opening, said bottom opening having a downlight lens retained therein and said side window opening having a wall wash lens therein.

17. A semi-recessed downlight wall wash luminaire, comprising:

a frame having a canopy sheeting, said frame adapted to be installed above a ceiling;

a lamp socket affixed to said frame and retaining a lamp;

a downlight reflector surrounding a first portion of said lamp;

a wall wash reflector surrounding a second portion of said lamp;

wherein said wall wash reflector extends downward below said frame and said downlight reflector;

a trim piece covering a lower exposed end of said semi-recessed luminaire.

18. The semi-recessed downlight wall wash luminaire of claim 17 wherein said wall wash reflector extends sufficiently around said lamp so as to reflect light from said lamp along a plane parallel to said canopy sheeting of said frame.

19. The semi-recessed down light wall wash luminaire of claim 18 wherein said first portion is about 240° around said lamp and wherein said second portion is about 120° around said lamp.

20. The semi-recessed down light wall wash luminaire of claim 18 wherein said trim piece is further comprised of a downlight lens suspended below said wall wash reflector and said down light reflector, said downlight lens having a plurality of toroidal optical elements to direct light from said lamp in an elongated pattern below said luminaire.

21. The semi-recessed downlight wall wash luminaire of claim 20 wherein said trim piece further has a wall wash lens along one side thereof.

22. The semi-recessed downlight wall wash luminaire of claim 21 wherein said wall wash lens has a plurality of fluted refractors formed thereon.

23. A semi-recessed luminaire, comprising:

a frame supporting a socket, said frame retaining a wall wash reflector and a down light reflector;

a lamp retained in said socket;

said downlight reflector sufficiently surrounding said lamp so as to reflect light downward along an elongated path;

still said wall wash reflector surrounding said lamp and extending below said frame sufficient to reflect light from said lamp on a plane parallel and below said frame;

a trim piece suspended below said frame and substantially surrounding a lower end of said wall wash reflector, said lower end of said wall wash reflector extending below said frame;

said trim piece further having a downlight lens and a wall wash lens affixed thereto.

* * * * *

UNITED STATES PATENT AND TRADEMARK OFFICE

CERTIFICATE OF CORRECTION

PATENT NO. : 6,561,670 B1
DATED : May 13, 2003
INVENTOR(S) : Mark Paul Jongewaard and Katsuhiro Unoki It is certified that error appears in the above-identified patent and that said Letters Patent is hereby corrected as shown below:

Column 2,
Line 11, change “piece-is” to -- piece is --;

Column 6,
Line 49, before “said”, delete “still”.

Signed and Sealed this

Twelfth Day of August, 2003

JAMES E. ROGAN
*Director of the United States Patent and Trademark Office*